United States Patent [19]

Füllemann et al.

[11] Patent Number: 5,015,173

[45] Date of Patent: May 14, 1991

[54] BURNER FOR THE COMBUSTION OF LIQUIDS IN THE GASEOUS STATE

[75] Inventors: Jörg Füllemann, Mastrils; Heinrich Boner, Malans, both of Switzerland

[73] Assignee: VTH AG Verfahrenstechnik fur Heizung, Vaduz, Liechtenstein

[21] Appl. No.: 358,673

[22] Filed: May 30, 1989

[30] Foreign Application Priority Data

Jun. 9, 1988 [CH] Switzerland ..... 02201/88

[51] Int. Cl.[5] ..... F23J 5/02

[52] U.S. Cl. ..... 431/116; 431/242; 431/243; 431/350; 431/354; 431/208; 431/168

[58] Field of Search ..... 431/116, 214, 208, 115, 431/242, 243, 168, 350, 348, 354

[56] References Cited

U.S. PATENT DOCUMENTS

| | | | |
|---|---|---|---|
| 1,755,846 | 4/1930 | Steed | 431/208 |
| 1,936,271 | 11/1933 | Schroeder et al. . | |
| 2,568,763 | 9/1951 | Ray | 431/208 |
| 2,857,961 | 10/1958 | Brown, III et al. | 431/116 |
| 2,867,270 | 1/1959 | Bezozowsk | 431/116 |
| 3,021,892 | 1/1959 | Brola . | |
| 3,127,924 | 4/1964 | Downs | 431/168 X |
| 3,175,600 | 11/1964 | Powell . | |
| 3,269,448 | 8/1966 | Martin | 431/116 X |
| 3,852,024 | 12/1974 | Carlsson | 431/208 |
| 3,986,815 | 10/1976 | Miyahara | 431/168 |
| 4,022,567 | 5/1977 | Miyahara . | |
| 4,604,104 | 8/1986 | Adis et al. | 431/116 X |
| 4,624,631 | 11/1986 | Kobayashi et al. | 431/350 X |
| 4,712,997 | 12/1987 | Fullemann et al. . | |

FOREIGN PATENT DOCUMENTS

| | | | |
|---|---|---|---|
| 2649669 | 5/1978 | Fed. Rep. of Germany . | |
| 3346431A1 | 7/1985 | Fed. Rep. of Germany . | |
| 1401127 | 12/1986 | Fed. Rep. of Germany | 431/116 |
| 3636787 | 5/1988 | Fed. Rep. of Germany . | |
| 7512676 | 11/1975 | France . | |
| 54-9026 | 1/1979 | Japan . | |
| 187974 | 4/1937 | Switzerland . | |
| 628724 | 3/1982 | Switzerland . | |

*Primary Examiner*—Carl D. Price

*Attorney, Agent, or Firm*—Frishauf, Holtz, Goodman & Woodward

[57] ABSTRACT

A stationary gasifier (17) is located at a distance (49) from an air aperture plate (35). At the outlet (42) of the gasifier there is a stationary mixing head (29) having a deflector section (31) and lateral outlets (33). Fuel is supplied coaxially through an opening (55) of the air aperture plate. A flame tube (21) surrounds the gasifier (17) and an electric heater (39) leaving an annular space (40). When the burner is started up, the electric heater (39) is switched on until the gasifier has the necessary operating temperature. Fuel is then supplied. The fuel-/air mixture is ignited by an electrode (65). The flame tube (21) extends to the end of the mixing head (29), or only a little therebeyond. A flame is formed at the outlets (33) that touches the flame tube after a short travel, then emerges from it and expands. Because the flame can immediately expand, only little $NO_x$ is formed. A portion of the hot combustion gases is recirculated through the annular space (40) and sucked into the gasifier to heat the gasifier (17) after the shutoff of the electric heater (39).

28 Claims, 2 Drawing Sheets

BURNER FOR THE COMBUSTION OF LIQUIDS IN THE GASEOUS STATE

FIELD OF THE INVENTION

This invention refers to a burner for the combustion of liquid fuel in the gaseous state, comprising a stationary gasifier having a proximal inlet and a distal outlet, a flame tube enclosing the gasifier with a space located in between them, that space between the gasifier and the flame tube serving as recirculation path for hot combustion gases to the inlet of the gasifier, and fuel supply means to the gasifier.

BACKGROUND

German patent disclosure No. 26 49 669 discloses a burner having a combustion chamber in which a rotating gasifier pot is located in the front region thereof which consists of a bottom and a tubular portion. The output opening of the gasifier pot is located at an axial distance from the front wall of combustion chamber. The tubular portion of the gasifier pot is enclosed at a radial distance by an annular diversion chamber, thus forming an injector channel for the flow of air.

German patent disclosure No. 33 46 431 remarks with respect to the burner disclosed in the previously described German patent disclosure that on a sufficient oversupply of air a good mixture of fuel and combustion air is obtained which is indicated by a blue flame. However, in continuous operation a high oversupply of air is not permissible, because then the $CO_2$-value and the combustion efficiency will not meet desired requirements. The additional air disturbs the heat balance in such a way that condensation takes place on the back wall. When operating close to the stoichiometric region insufficient mixing of oil vapors, fresh air and combustion gases takes place. When, for ameliorating the mixing operation, baffles or bypasses were inserted or a change of the injector geometry was made, a lowering of the injector action took place. In turn, this caused reduction of the recirculation of combustion gases. Further, the temperature balance was negatively affected, and condensation effects and an inpermissible high increase of the $NO_x$ and CO gases took place. Accordingly, the German patent disclosure No. 33 46 431 had the object to improve the burner according to the earlier German patent disclosure No. 26 49 669 in such a way that the oil vapor is well mixed with fresh air and combustion gas without negatively affecting the injector action. The improved burner according to the cited German patent disclosure also has a rotating evaporator cup. This cup is closed on the flame side and has an outlet for the evaporated fuel only on the motor side. The evaporator cup is provided with a plurality of rows of holes distributed over the circumference and is surrounded by a annular deflection chamber for the air supply. Gasified fuel and air then flow between the evaporator cup and the flame tube in two concentric flows of annular cross section, strike a baffle ring, mix, and then form a flame. The disadvantage is that the evaporator chamber is not subject to a forceful flow of hot gases, and therefore deposits form there that soon impair the function of the burner. In particular, a major emission of unburned hydrocarbons occurs upon shutoff of the burner.

French patent No. 2 269 029 also discloses a burner having a rotating evaporator cup that is closed on the flame side. The evaporator cup is lined on the inside with a wire mesh, which serves to prevent an outflow of the fuel. This burner needs a strong blower that requires a relatively large amount of energy, because the fresh air and the air and gas mixture are deflected several times. Another disadvantage is that, after shutoff of the burner, a large amount of fuel is still evaporating from the wire mesh, which was previously swept with air and therefore has remained relatively cool; once again, a major emission of hydrocarbons is the result.

In the burner according to the Swiss patent No. 628 724 a so-called mixing tube and a flame tube are provided coaxially to a nozzle. In operation, oil is atomized by the nozzle into the mixing tube into which also the air necessary for combustion is blown. At the distal end of the mixing tube a flame is formed. A part of the hot combustion gases is then recirculated by injector effect back to the inlet of the mixing tube. There it is mixed with the oilmist/air mixture to provide a heat exchange. Thanks to the recirculation of a part of the combustion gases this burner permits a substantial gasification of the oil droplets in the mixing tube. Therefore a relatively good combustion with little soot formation takes place. However, this advantage is at the expense of an increased formation of nitrogen oxides ($NO_x$). The burner requires a relatively long flame tube. Because an expansion of the flame takes only place after it leaves the flame tube, there exists a relatively large flame zone with high temperature. This facilitates formation of nitric oxides. A further disadvantage of the burner is caused by the fact that on start the mixing tube is cold, and therefore does not cause evaporation. For this reason the flame is very sooty until the mixing tube reaches a high temperature and is in a position to vaporize efficiently the oil droplets hitting it.

SUMMARY OF THE INVENTION

Therefore, it is an object of the present invention to provide a burner described in the introduction but which avoids at least part of the above mentioned disadvantages. The burner should be reliable in operation and require only little maintenance. The burner should also comply with stringent requirements of environmental protection, provide clean combustion, generate only small amounts of nitric oxides and, on starting and shutting off, not cause emissions of unburned hydrocarbons.

Briefly, according to a feature of the invention, a stationary mixing head with outlet openings for a combustible gas mixture is located at the outlet of the gasifier. The stationary gasifier has a proximal inlet and a distal outlet. A flame tube encloses the gasifier with a space located in between, the space between the gasifier and the flame tube serving as recirculation path for hot combustion gases to the inlet of the gasifier. A fuel supply means to the gasifier is provided and stationary mixing head at the output of the gasifier. This combination has no moving elements, and already for this reason is very reliable in operation. By the recirculation of hot gases the gasifier is strongly heated which effectively prevents coking. The high temperature of the gasifier also provides safe gasification of fuel on shut-off of the burner, so that in this phase no impermissible emissions of unburned hydrocarbons take place. Of particular importance is the fact that the flame tube can be kept short without impairing the injection effect and the recirculation of hot combusting gases to the gasifier input. The mixing head at the end of the gasifier causes the flame, already after a short distance, to touch, or impinge against to the flame tube, whereupon it can exit from the flame tube and expand radially. This expansion provides for a lowering of the flame temperature. From the view of environmental protection a lower flame temperature has the important advantage that only little nitric oxides are formed. The mixing head has a deflector section for the deflection of the outflowing gas mixture in a essentially radial direction. This permits, for the purpose of preventing formation of nitrogen oxides, use of a flame tube which is short so that the flame can immediately expand faster than in prior art structures. Preferably, the flame tube extends to the end of the mixing head, or only little there beyond.

The gasifier and the mixing head may form a single component unit. The gasifier and the mixing head may be of tubular form. The mixing unit may consist of a section of a tube or of a piece of sheet metal being so formed as to provide a tubular section. In this way manufacturing is substantially simplified and therefore inexpensive. In order to prevent that fuel leaks from the end of the tubular section, it is advisable to provide at the outlet of the gasifier an annular radially inwardly oriented extension, for example formed by a necked-down portion. It is also possible to provide at the inlet of the gasifier an inwardly extending flange. This flange can be formed by flanging. In order to heat the gasifier at the start of the burner, it is advisable to provide an electric heater. In this case the gasifier is heated prior to opening the fuel supply. This avoids accumulation of impermissible amounts of unburned hydrocarbons at the beginning of the heating cycle. Preferably, gasifier, mixing head, deflector section, aperture plate, and electric heater form a component unit. Such a component unit can easily be exchanged on a service call. The flame tube may be arranged coaxially to and spaced apart from the gasifier and the electric heater. This provides a preferred construction by which the recirculated hot combustion gases provide for equalized heating of the gasifier.

The combination of the electric heater and the recirculation path has the advantage that shortly after start the electric heater can be switched off, because the gasifier is kept at the desired high operating temperature by the recirculated hot gases.

Fuel may be fed into the gasifier in different ways. For example a rotating slinger, or spraying device may be provided at the inlet of the gasifier. Such a rotating spraying device provides for equal distribution of the fuel in the gasifier. Particularly for burners in the upper power range, it is advisable to provide an atomizer nozzle at the inlet. The nozzle is preferably located coaxially to the gasifier. With an atomizer nozzle the fuel can be finely distributed on the gasifier walls. Of particular advantage is an atomizing nozzle of the type of a hollow cone nozzle. The atomizing nozzle may also be designed to direct at least one atomized fuel stream in form of a beam of limited divergence angle against the wall of the gasifier. In this case it is advisable that in the region of the respective atomized fuel beam the aperture plate is provided with a shield section. By this shield section the atomized fuel beam will be shielded from the inflowing air in such a way that it safely reaches the gasifier wall. Substantially no oil droplets will be entrained by the air stream and carried to the mixing head. The aperture plate is advantageously located at a distance from the gasifier, with the gap between the aperture plate and the gasifier providing a recirculation inlet. Because of this arrangement hot recirculating gases will flow primarily along the inner wall of the gasifier, whereas the cold air will flow more in the centre of the gasifier. This is a good location for an ignition electrode, and further provides for excellent evaporation of the fuel and prevents evaporation of fuel after the burner stops. On switching off of the burner the gasifier is still very hot so that the remaining fuel will evaporate in a short time and burn with the air which will still be supplied until the burner comes to a final stop.

The gasifier may be provided with means such as metal cloth, for increasing its surface area above the surface area which the gasifier would have if it were smooth, that is, above the area of a theoretical envelope of the surface of the gasifier. This provides for an effective increase of the fuel film and speeds up gasification. The use of metal cloth or a porous sinter material provides for capillary forces which facilitate distribution of fuel over the whole gasifier wall. The means for increasing the surface area are preferably formed by an insert that at least partially covers the inner wall of the gasifier. Such an insert can, if necessary, easily be replaced on a service call. Because the liquid fuel comes immediately into contact with the extended surface area, of metal cloth, capillary forces will be effective immediately to distribute the fuel over the whole inner surface of the gasifier. The insert may have a flange protruding practically radially inward. This causes possible oil droplets to be caught and evaporated on the hot surface of the insert. For this reason the flange of the insert is located advantageously at the distal end of the gasifier. To control the fuel supply a volustat may be provided. A volustat is a device that provides a predetermined volume per unit of time according to an input signal. This rate is practically not influenced by flow resistance in the supply line. The supply rate is also practically was affected by the viscosity of the fuel.

Preferably, an air aperture plate with an opening for air supply to the inlet to the gasifier is provided. This opening is preferably centrally located and serves as opening for the drive shaft of a rotating spraying device or as opening for an atomizing nozzle.

It is possible to arrange the burner vertically instead of horizontally. This provides for flexibility in using the burner.

DRAWINGS

Figure 1:
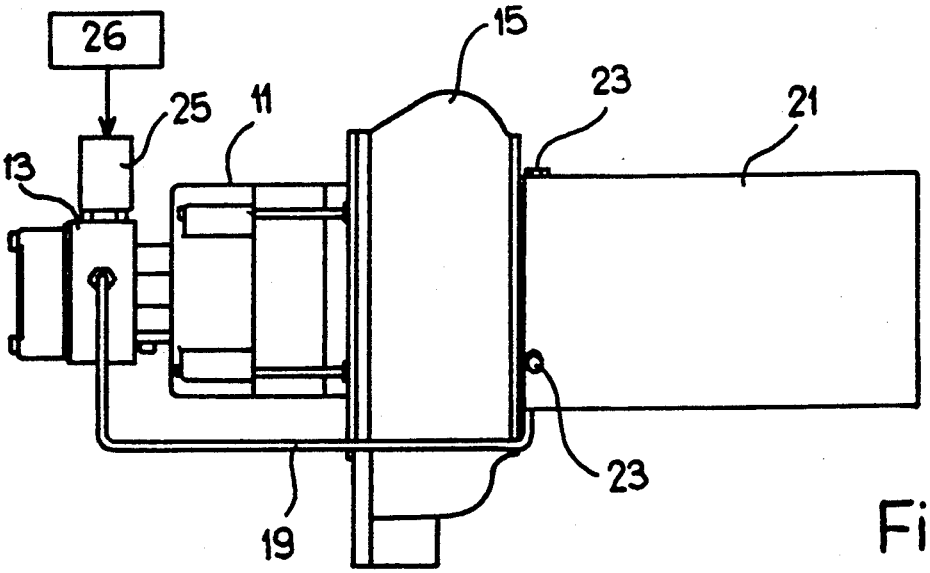
FIG. 1 shows a view of a burner according to the invention.
Figure 4:
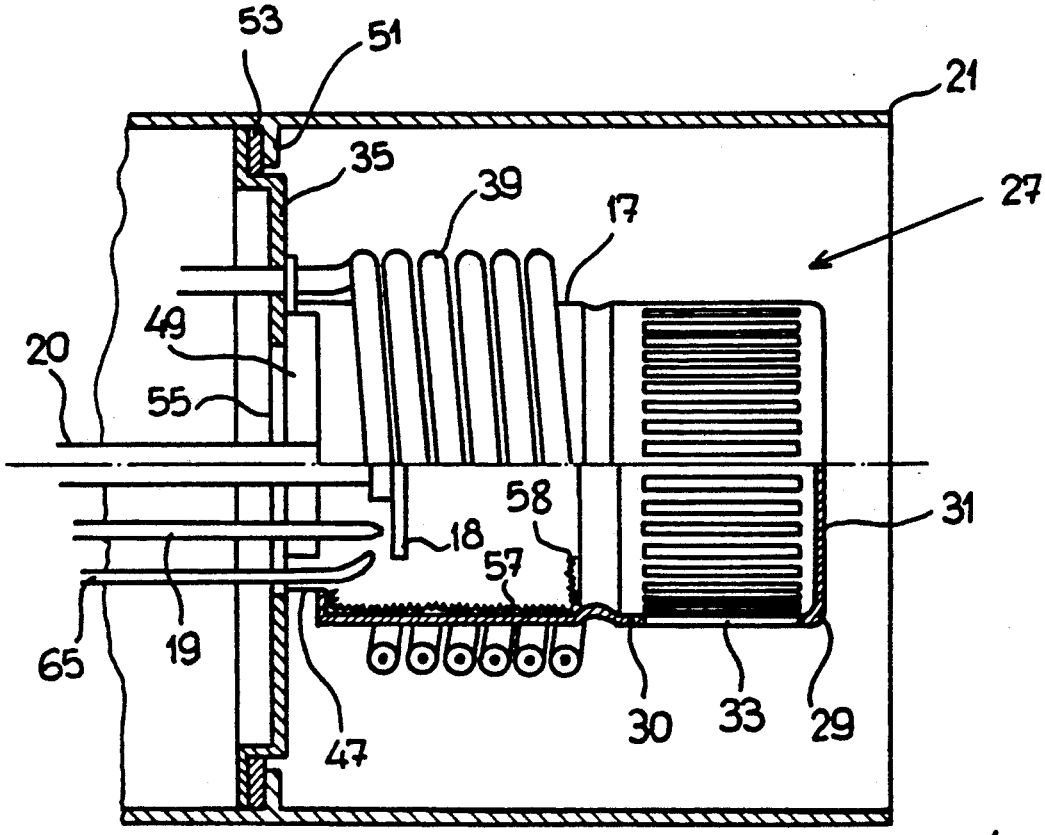
FIG. 4 shows a cross section through a second embodiment of the burner provided with a rotating spraying device.

The burner shown in FIG. 1 has a motor 11, which is used to drive the fuel pump 13, the fan 15 and optionally a rotatable spraying device 18 (FIG. 4). From the fuel pump 13 a fuel line 19 leads to the gasifier 17 (FIG. 2), which is surrounded by a flame tube 21. The flame tube can be removed easily by losening the screws 23. A volustat, a magnetic valve or another suitable device 25 is used to control the fuel supply in accordance with control commands of the heating control system 26.

Volustats are made by the SATRONIK CO. in Regensdorf, Switzerland, for example.

Figure 2:
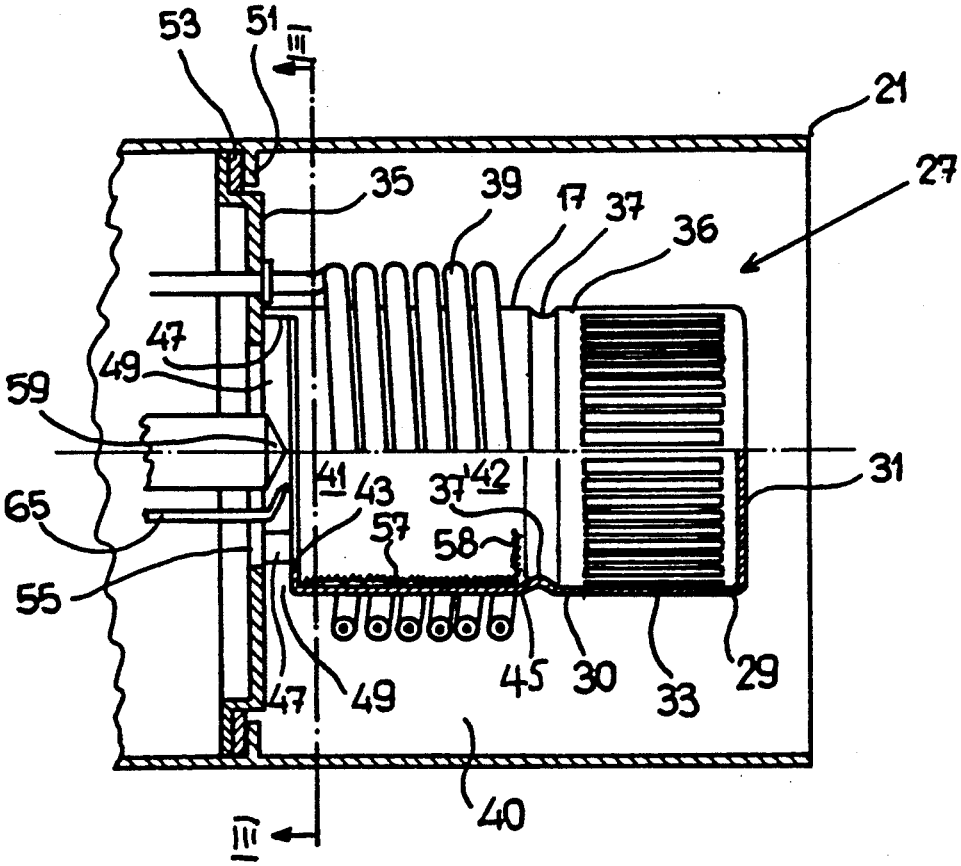
FIG. 2 shows a longitudinal cross section through a first embodiment of the burner having a atomizer nozzle.

FIG. 2 shows an easily replaceable component unit 27 which substantially comprises the gasifier 17, the mixing head 29, the air aperture plate 35, the electric heater 39 and further optionally connected parts. The mixing head 29 and the gasifier 17 are an integral part which includes a disk-like deflector section 31. The component unit 27 is surrounded by the flame tube 21. The flame tube 21 is relatively short. It extends only to the end of the mixing head 29, as shown schematically by line A—A on FIG. 2 or a little bit beyond, as shown schematically by line B—B on FIG. 4. A plane across the end of the flame tube 21 will be in at least approximate alignment with the disk-like deflector section 31, forming the end of the mixing head 29. The space 40 between the gasifier and the flame tube 21 forms the recirculation path for hot combustion gases to the inlet 41.

The gasifier 17 and the mixing head 29 are formed as a hollow body of rotational (or) symmetry. In the exemplary embodiment shown, the gasifier takes the form of a single cylindrical tube section 30 that at the front is closed by a disc 31. The disc 31 serves as a deflector section for the gas mixture. The gas mixture may issue from a plurality of outlet openings 33. In the embodiment shown, the outlet openings 33 have the form of slits. They may have also a different form, however. Because the outlet openings 33 are located in the tubular section 36 of the mixing head the gases issue from the mixing head 29 in practically radial direction. In the exemplary embodiment shown, the boundary between the gasifier 17 and the mixing head 29 is formed by a constriction 37. This constriction 37 forms a radially inwardly oriented extension 37' at the distally located outlet 42 of the gasifier 17. This inwardly oriented extension 37' prevents a flow of liquid fuel from the gasifier 17 into the mixing head 29. At the proximal end 41, that is at the inlet of the gasifier 17, a inwardly extending flange 43 prevents leakage of liquid fuel.

The unit 45 comprising the gasifier 17 and the mixing head 29 is mounted, for example with three struts 47 on an air aperture plate 35. The attachment may be by welding or riveting or the like. The struts 47 may be extensions of the tube 30. The spaces between the struts 47 form recirculation inlets 49.

The component unit 27 is mounted on a flange 51 of the flame tube 21, for example by means of screws (not shown). A seal ring 53 of heat resistant material provides a particularly air tight connection. This assures that the air required for combustion can only flow through the central opening 55 of the air aperture plate 35.

Figure 3:
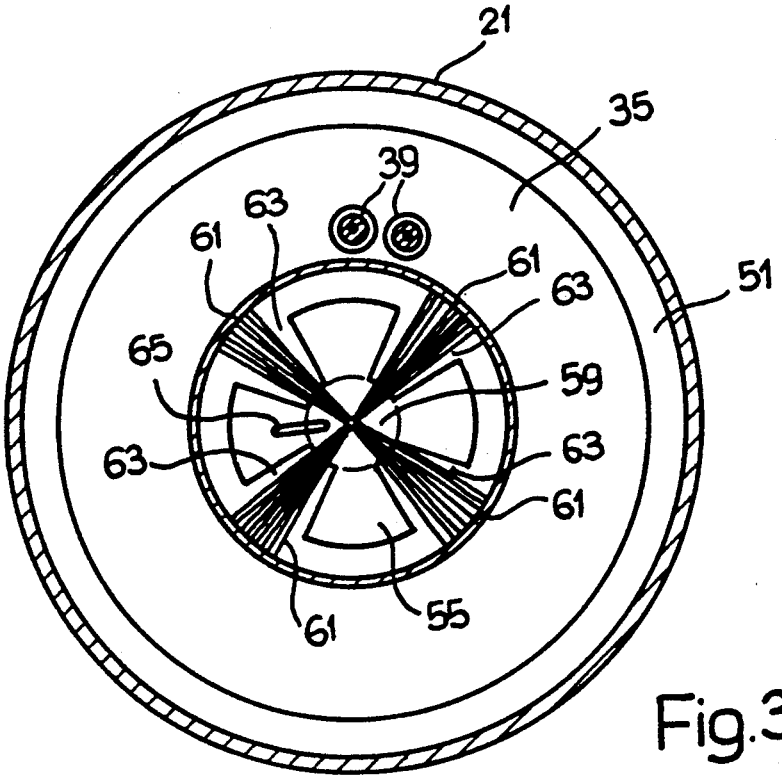
FIG. 3 shows a cross section along the line III—III of FIG. 2.

The gasifier 17 is surrounded by the electric heater 39. In the exemplary embodiment shown the electric heater 39 is located concentrically to the gasifier 17, but closely spaced therefrom. In this case the heating of the gasifier 17 takes place only by radiation. A better heat transfer is obtained, by having the winding of the electric heater 39 in direct contact with the wall of the gasifier 17. It has proved to be advantageous to provide a means for increasing the surface area in the gasifier 17. These means, for example, may be an insert 57 made from a metal cloth. By means of a metal cloth of this kind, capillary action is brought about, which finely distributes the fuel over the inside wall of the gasifier. However, it would also be possible, to provide the inner wall of the gasifier 17 with a layer of porous ceramic material. The insert 57 has an essentially radially inwardly extending flange 58 serving to catch eventual oil droplets, so that they do not enter the mixing head. At the inlet 41 of the gasifier 17 an atomizer nozzle 59 is provided. It is a hollow cone nozzle. In the embodiment according to FIG. 3, the nozzle 59 provides for different atomized fuel jets 61 having a restricted diversion angle. In order to protect these atomized fuel jets 61 from being deflected by the inflowing air, the air aperture plate 35 has a shield section 63 in the region of each atomized fuel jet 61.

On the embodiment of FIG. 4 a rotating fuel or slinger device 18 is provided. This device 18 is driven by the shaft 20 of the motor 11 (FIG. 1). The fuel line 19 extends close to the rotating spraying device 18. The ignition electrodes 65 extend into the gasifier space. Ignition in the gasifier space has the advantage that on ignition a pressure surge is substantially avoided. Accordingly, a smooth start takes place. Further, ignition is fast, because at the start higher temperatures are found in the gasifier 17 than at the outlet openings 33 of the mixing head 29.

The present invention is related to the burner described and claimed in our earlier application, U.S. Ser. No. 07/167,300, filed Mar. 11, 1988, now patent which however, uses a rotary gasifier to which a rotary mixing head is coupled, for example formed by axially extending blades, or by radially extending fan-like blades.

Various changes and modifications may be made, and features described in connection with any one of the embodiments may be used with any of the others, within the scope of the inventive concept.

We claim:

1. A burner comprising a stationary gasifier (17) being formed as a hollow body, said gasifier including means (19, 59) for supplying fuel to the interior of the hollow body;

an inlet (41) for air into the hollow body; and an outlet (42) from the inside of the hollow body for a combustible gas/air mixture;

a stationary, hollow mixing head (29) coupled to the outlet (42) of the gasifier, said mixing head being formed with outlet openings (33) at outer walls thereof for intimately mixing said combustible gas/air mixture, and issuing said combustible gas/air mixture, said mixing head (29) including a deflector section (31) positioned for deflection of said gas/air mixture through said openings (33), in substantially radial direction for formation of a flame, after ignition of said combustible gas/air mixture, which expands essentially radially from said mixing head (29); and a flame tube (21) surrounding and spaced apart from the gasifier (17) and the mixing head (29), and axially extending approximately to the end of the mixing head (29), so that a plane across the end of the flame tube and a plane across the end of the mixing head will be in approximate alignment to permit radial expansion of the flame shortly after the flame resulting from ejection of the gas/air mixture through said openings (33) touches the flame tube.

2. The burner as claimed in claim 1 wherein said mixing head (29) and said gasifier (17) are coaxially arranged.

3. The burner as claimed in claim 1 wherein said gasifier (17) and said mixing head (29) comprise a unitary tubular structure;

and means forming a constriction (37) between the outlet from the gasifier and the mixing head for increasing turbulence in the combustible gas/air mixture formed in the gasifier and passing into the mixing head.

4. A burner as claimed in claim 1 wherein said mixing head comprises a cap-like structure having a cylindrical wall formed with said outer openings (33) therein, and a solid, essentially disk-like end wall (31), wherein said disk-like end wall forms said deflection section (31).

5. A burner as claimed in claim 1 further including an air aperture plate (35) formed with an air supply opening (55) and located adjacent the inlet (41) of the gasifier; and an ignition electrode (65) located in the path of air flow through said air supply opening (55).

6. A burner as claimed in claim 1 wherein the flame tube (21) extends axially only to the end of the mixing head.

7. A burner as claimed in claim 1 wherein the mixing head (29) comprises a cylindrical structure and said outer openings (33) of the mixing head are axially extending slits formed in said structure.

8. A burner as claimed in claim 1, wherein the flame tube (21) extends to slightly beyond the end of the mixing head (29).

9. A burner as claimed in claim 1, wherein the gasifier (17) and the mixing head (29) form a single unit.

10. A burner as claimed in claim 1, wherein the gasifier (17) and the mixing head (29) are of tubular form.

11. A burner as claimed in claim 1, wherein an annular, radially inwardly oriented ridge (37'), is provided at the outlet (42) of the gasifier (17).

12. A burner as claimed in claim 1, wherein an inwardly extending flange (43) is provided at the inlet (41) of the gasifier.

13. A burner as claimed in claim 1, wherein means (25) are provided for controlling the fuel supply in accordance with controlled commands.

14. A burner as claimed in claim 1, wherein a rotary spraying device (18) at the inlet (41) of the gasifier is provided.

15. A burner as claimed in claim 1, wherein an air aperture plate (35) with an opening (55) for the supply of air to the inlet (41) of the gasifier (17) is provided on the inlet side of the gasifier.

16. A burner as claimed in claim 15, wherein the air aperture plate (35) is located at a distance from the gasifier (17), whereby the gap between the aperture plate and the gasifier (17) provides a recirculation inlet (49) to the gasifier.

17. A burner as claimed in claim 1, wherein an electric heater (39) is provided for the gasifier (17).

18. A burner as claimed in claim 17, characterized in that the gasifier (17), the mixing head (29), the deflector section (31), the air aperture plate (35), and the electric heater form a component unit.

19. A burner as claimed in claim 17, wherein the flame tube (21) is arranged coaxially to and spaced apart from the gasifier (17) and the electric heater (39).

20. A burner as claimed in claim 1, wherein an atomizer nozzle (59) is located at the inlet (41) of the gasifier (17).

21. A burner as claimed in claim 20, wherein the atomizing nozzle is a hollow cone nozzle.

22. A burner as claimed in claim 20, wherein the atomizing nozzle is designed to direct at least one atomized fuel beam (61) of limited divergence angle against a wall of the gasifier.

23. A burner as claimed in çlaim 22, wherein an air aperture plate (35) with an opening (55) for the supply of air to the inlet (41) of the gasifier (17) is provided on the inlet side of the gasifier; and wherein the respective regions of the atomized fuel beam (61) and the aperture plate (35) are provided with a shield section.

24. A burner as claimed in 1, wherein the gasifier has means (57) for increasing its effective surface area.

25. A burner as claimed in claim 24, wherein the means for increasing the surface area of the gasifier are formed by an insert (65) of metal cloth that at least partially covers the inner wall of the gasifier (17).

26. A burner as claimed in claim 25, wherein said insert has a flange (66) protruding substantially radially inward.

27. A burner as claimed in claim 26, wherein a flange (58) of said insert (57) is located at the distal end of the gasifier (17).

28. A burner as claimed in claim 1, wherein an ignition electrode (65) is located at the inlet (41) to the gasifier (17).

* * * * *